US007852144B1

(12) United States Patent
Zonte et al.

(10) Patent No.: US 7,852,144 B1
(45) Date of Patent: Dec. 14, 2010

(54) CURRENT REFERENCE SYSTEM AND METHOD

(75) Inventors: Cristinel Zonte, Colorado Springs, CO (US); Vijay Kumar Srinivasa Raghavan, Colorado Springs, CO (US)

(73) Assignee: Cypress Semiconductor Corporation, San Jose, CA (US)

( * ) Notice: Subject to any disclaimer, the term of this patent is extended or adjusted under 35 U.S.C. 154(b) by 115 days.

(21) Appl. No.: 11/904,642

(22) Filed: Sep. 28, 2007

Related U.S. Application Data

(60) Provisional application No. 60/848,558, filed on Sep. 29, 2006.

(51) Int. Cl.
*G05F 3/02* (2006.01)

(52) U.S. Cl. ..... 327/543; 327/513

(58) Field of Classification Search ..... None
See application file for complete search history.

(56) References Cited

U.S. PATENT DOCUMENTS

| | | | | |
|---|---|---|---|---|
| 5,889,394 | A * | 3/1999 | Czarnocki | 323/313 |
| 6,992,533 | B2 * | 1/2006 | Hollinger et al. | 331/143 |
| 7,224,210 | B2 * | 5/2007 | Garlapati et al. | 327/539 |
| 7,301,321 | B1 * | 11/2007 | Uang et al. | 323/313 |
| 7,321,225 | B2 * | 1/2008 | Garlapati et al. | 323/313 |
| 7,372,316 | B2 * | 5/2008 | Chatterjee et al. | 327/513 |
| 7,411,443 | B2 * | 8/2008 | Ivanov et al. | 327/539 |
| 2005/0134365 | A1 * | 6/2005 | Kimura | 327/543 |
| 2005/0206443 | A1 * | 9/2005 | Chatal et al. | 327/538 |
| 2007/0080740 | A1 * | 4/2007 | Berens et al. | 327/539 |

OTHER PUBLICATIONS

Oguey et al., "CMOS Current Reference Without Resistance," IEEE Journal of Solid-State Circuits, vol. 32, No. 7, Jul. 1997, pp. 1132-1135; 4 pages.

* cited by examiner

*Primary Examiner*—Cassandra Cox

(57) ABSTRACT

A relatively precise and accurate current reference system and method are described. The present current reference system and method facilitate realization of relatively high accuracy and precision in current references independent of process, voltage and temperature (PVT) variations. In one embodiment, a current reference system includes an opamp (operational amplifier), a first transistor and second transistor, a first resistor and a second resistor of different temperature coefficients, and a third transistor and fourth transistor. The opamp indicates and corrects the potential difference between a first branch and a second branch. The first transistor and second transistor mirror currents in the first branch and the second branch. The first resistor and a second resistor of different temperature coefficients cause voltage drops across them in a manner that compensates for PTAT variations. The third transistor and fourth transistor provide voltages between respective bases and emitters.

21 Claims, 4 Drawing Sheets

100B

100A

100B

CURRENT REFERENCE SYSTEM AND METHOD

RELATED APPLICATIONS

This application claims the benefit and priority of co-pending provisional application No. 60/848,558 entitled CURRENT REFERENCE SYSTEM AND METHOD filed Sep. 29, 2006, which is incorporated herein by reference.

TECHNICAL FIELD

The present invention relates generally to electronic circuits and in particular to current reference systems and methods.

BACKGROUND

Electronic systems and circuits have made a significant contribution towards the advancement of modern society and are utilized in a number of applications to achieve advantageous results. Numerous electronic technologies such as digital computers, calculators, audio devices, video equipment, and telephone systems facilitate increased productivity and cost reduction in analyzing and communicating data, ideas and trends in most areas of business, science, education and entertainment. Many of the electronic systems that provide these advantageous results often utilize reference currents in the performance of designated tasks. However, traditional precision reference current approaches are usually very expensive and often relatively limited.

A number of electronic components depend upon accurate reference currents to provide reliable results. Precision current references are often utilized in a variety of applications including precision delay stages, current sensing circuits for read paths in memories and timing circuits. However, maintaining relatively high accuracy and precision of such reference currents across process voltage and temperature (PVT) variations is usually very difficult and expensive.

Non-volatile memory macros with minimum area for embedded applications often utilize a reference current. These applications often use single ended memory bit cells instead of differential bit cells to conserve area. Relatively precise current references are utilized in the read sense path in order for such memory macros using single ended sensing schemes to have a fast read access along with good sense margin. These relatively precise current references are then used to design precision delay stages for use in the sense timing path or as a reference current to compare against in a current sensing scheme.

Traditional attempts at providing a precise current reference are usually expensive and often limited in precision. For example, given a zero temperature co-efficient (TC) voltage reference (e.g., a band gap reference), the classical way of getting a current reference is by designing a circuit that will give a current of Vref/R. In other traditional attempts, a current reference based on a proportional to absolute temperature (PTAT) voltage applied to a positive TC resistor (e.g., serial and parallel combination of resistors) is utilized. The resulting resistor should have the TC equal to the PTAT voltage ($TC_R$=$TC_{PTAT}$). Another convention attempt utilizes an Oguey's Current Reference (Ref: "CMOS Current Reference Without Resistance" by Henri J. Oguey, IEEE JSSC, vol. 32, No. 7, p. 573, July 1997). There are other current references based on Vt (e.g., threshold of MOSFET) where in the final current reference is given by Vt/R. The current references mentioned above usually require either special off-chip expensive resistors, are very sensitive to transistors mismatch or vary a lot across PVT.

SUMMARY

A relatively precise and accurate current reference system and method are described. The present current reference system and method facilitate realization of relatively high accuracy and precision in current references independent of process, voltage and temperature (PVT) variations. In one embodiment, a current reference system includes an opamp (operational amplifier), a first transistor and second transistor, a first resistor and a second resistor of different temperature coefficients, and a third transistor and a fourth transistor. By virtue of negative feedback, the opamp helps in maintaining close to zero potential difference at its inputs. The first transistor and second transistor mirror currents in the first branch and the second branch. The first resistor and second resistor of different temperature coefficients cause voltage drops across them in a manner that compensates for PTAT variations. The third transistor and fourth transistor provide voltages between respective bases and emitters, the difference (delta) between these voltages being the PTAT voltage.

DETAILED DESCRIPTION

Reference will now be made to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one ordinarily skilled in the art that the present invention may be practiced without these specific details. In other instances, well known methods, procedures, components, and circuits have not been described in detail as not to unnecessarily obscure aspects of the current invention.

Embodiments of the present invention are well suited to performing various other steps or variations of the steps recited herein, and in a sequence other than that depicted and/or described herein. It is appreciated that embodiments of the present invention can include hardware, firmware, and/or software. In one embodiment, processors and other electrical and electronic components perform processing associated with the present invention (e.g., executing computer readable and computer executable instructions comprising code included in a computer usable medium).

Figure 1A:
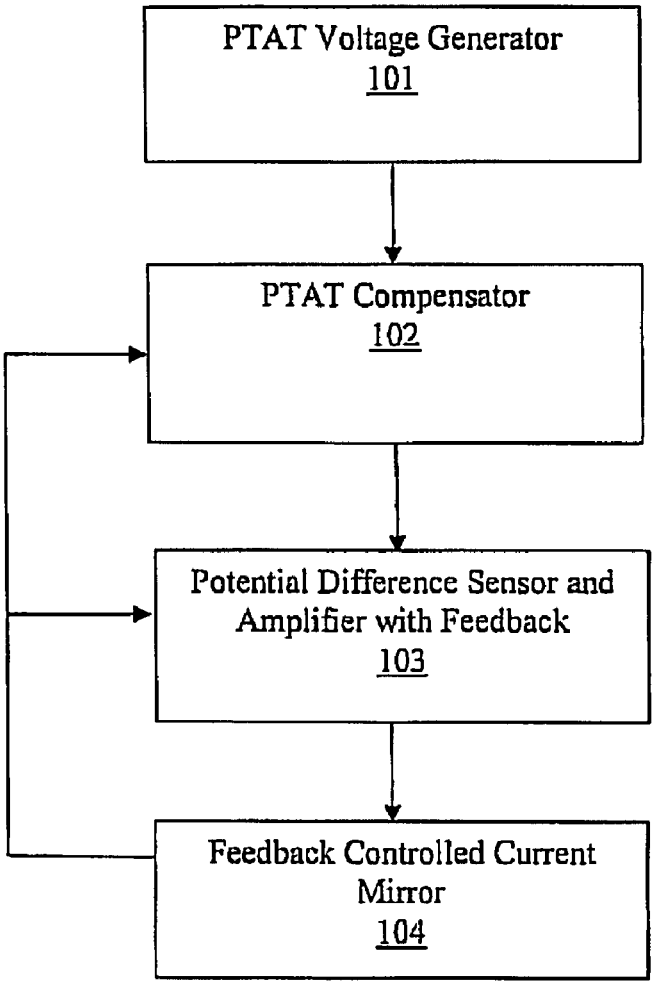
FIG. 1A is a block diagram of exemplary reference current system 100A in accordance with one embodiment of the present invention.

The present invention current reference systems and methods facilitate maintenance of relatively high accuracy and precision across relatively large process, voltage and temperature (PVT) variations. In one exemplary implementation, a relatively stable current is generated by means of compensating a PTAT type variation with two types of resistors having different temperature coefficients. FIG. 1A is a block diagram of exemplary reference current system 100A in accordance with one embodiment of the present invention. Exemplary reference current system 100A includes a PTAT voltage generator 101, a PTAT compensator 102, a potential difference sensor/amplifier with feedback 103, a feedback controlled current mirror 104.

The components of exemplary reference current system 100A cooperatively operate to provide a reliable current source with compensation for PVT variations. Component 101 generates a voltage difference that is proportional to absolute temperature. In one embodiment, the component 101 includes two bipolar junction transistors of different current densities. Component 102 compensates the PTAT variations between components of the first branch and the second branch. In one exemplary implementation, PTAT compensator comprises a first resistor and a second resistor of different temperature coefficients for resisting current flow through the first branch and the second branch in a manner that compensates for PTAT variations. Component 103 amplifies the voltage differential at its input so as to form a net negative feedback system. In one embodiment, component 103 is an operational amplifier. Component 104 is a feedback controlled current mirror that completes the negative feedback system by mirroring currents in the first and the second branch.

Figure 1B:
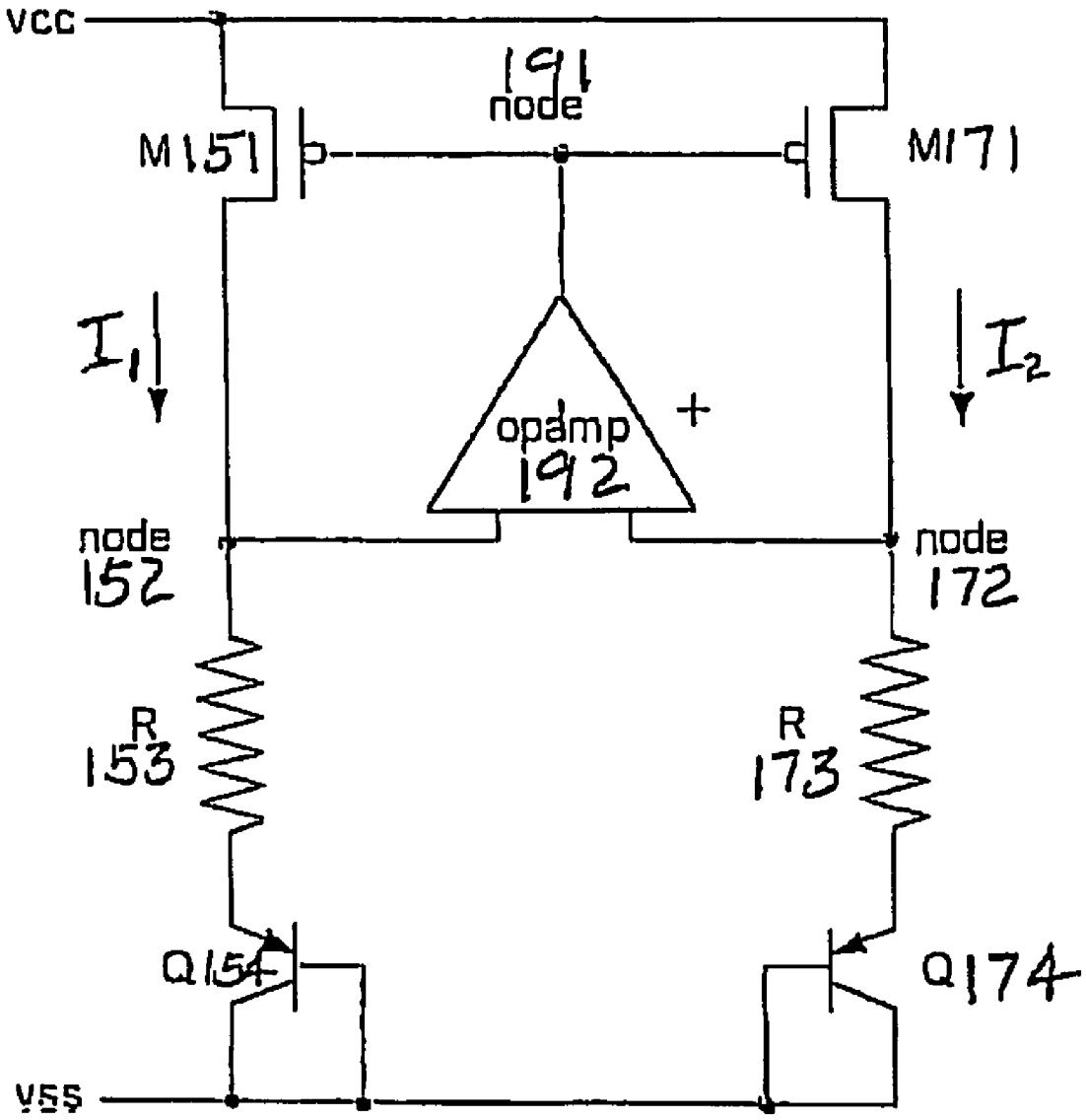
FIG. 1B is a schematic of an exemplary reference system in accordance with one embodiment of the present invention.

FIG. 1B is a schematic of exemplary reference current system 100B in accordance with one embodiment of the present invention. Exemplary current system 100B is one embodiment of exemplary reference current system 100A. Reference current system 100B includes transistors 151, 154, 171 and 174, resistors 153 and 173 and op amp 192. In one embodiment transistors 151 and 171 are PMOS transistors and transistors 154 and 174 are PNP BJTs. Inputs of Op Amp 192 are coupled to the drains of transistors 151 and 171, and resistors 153 and 173 which in turn are coupled to the emitters of transistors 154 and 174.

The components of reference current system 100 cooperatively operate to provide a relatively precise current reference. Transistors 151 and 171 provide a mirror current in response to differential indications from Opamp 192. Opamp 192 provides an output to node 191 to ensure that the voltage at nodes 152 and node 172 are approximately equal. Resistors 153 and 173 provide resistances of different temperature coefficients. Transistors 154 and 174 provide a voltage base emitter delta. In one embodiment, transistors 151 and 171 are PMOS transistors and transistors 154 and 174 are PNP BJTs.

In one embodiment, the area of transistor 154 is P times the area of transistor 174. Transistors 151 and 171 are sized such that the current through transistor 171 is N times the current through transistor 151. Resistors 153 and 173 are made of two different materials such that their temperature co-efficient are different from each other. In one embodiment, the second order temperature co-efficient of the resistors are ignored.

In one embodiment, the current reference works using resistors of two different temperature co-efficients. It is not required that the resistor be an expensive ultra low temperature co-efficient resistor. Hence, any pair of on-chip resistors like diffusion, poly, local inter-connect (li), or metal resistors will work as long as their temperature co-efficients are different.

In one exemplary implementation a current reference has an accuracy of +/−1% across temperature variations, +/−2% across transistor process (excluding parasitic resistor corners) and is +/−6% across PVT variations.

In one embodiment, operations of an exemplary reference current system and method can be expressed by the following equations. With reference to FIG. 1B, the voltages at node 152 and node 172 are almost equal due to opamp negative feedback action and control the total voltage drop in the lower part of the first branch and second branch, which can be expressed by the following:

$$I_1R_1+V_{eb1}=I_2R_2+V_{eb2}\rightarrow \quad \text{Eqn. 1}$$

wherein $I_1$ is the current through resistor 153, $I_2$ is the current through resistor 173, $R_1$ is resistance of resistor 153, $R_2$ is resistance of resistor 173, $V_{eb1}$ and $V_{eb2}$ are emitter to base voltages of BJTs 154 and 174 respectively. The current relationship between the first branch and the second branch can be expressed as the following:

$$I_2=N^*I_1\rightarrow \quad \text{Eqn. 2}$$

The delta Vbe can be expressed by the following:

$$V_{eb2}-V_{eb1}=\left(\frac{KT}{q}\right)\ln(NP)\rightarrow Eqn.3$$

where K is the Boltzmann constant, q is the electronic charge, T is the temperature in Kelvin.

By combining the prior 3 equations the reference current is expressed as:

$$I_1=\Delta Vbe/(R1-R2)$$

Which in turn can be expressed as:

$$I_1=\frac{\left(\frac{KT}{q}\right)\ln(NP)}{R_{10}[1+\alpha_1(T-T_0)]-NR_{20}[1+\alpha_2(T-T_0)]}\rightarrow Eqn.4$$

where $T_0$ is temperature related constant term. Differentiating with respect to temperature makes the expression independent of temperature and permits the temperature variable to be eliminated as follows:

$$\frac{\partial I_1}{\partial T}=0(R_{10}[1+\alpha_1(T-T_0)]-NR_{20}[1+\alpha_2(T-T_0)])\left(\frac{K}{q}\right)\ln(NP)=$$

$$(\alpha_1R_{10}-\alpha_2NR_{20})\left(\frac{KT}{q}\right)\ln(NP)\frac{R_{10}}{R_{20}}=N\left[\frac{1-\alpha_2T_0}{1-\alpha_1T_0}\right]\rightarrow Eqn.5$$

By appropriately setting the value of the first resistor, the second resistor and N, equation 5 can be satisfied. Substituting equation 5 into equation 4 results in the expression for a constant current reference independent of transistor process corner, voltage and temperature and is:

$$I_1 = \frac{\left(\frac{K}{q}\right)\ln(NP)}{\alpha_1 R_{10} - \alpha_2 N R_{20}} \rightarrow Eqn.6$$

where K is the Boltzmann constant, q is the electron charge constant, N is a ratio (constant) of the currents of transistors 171 and 151; P is the ratio of area between transistors 154 and 174; $\alpha_1$ and $\alpha_2$ are the constant first order temperature coefficients of the respective first and second resistors.

Figure 2:
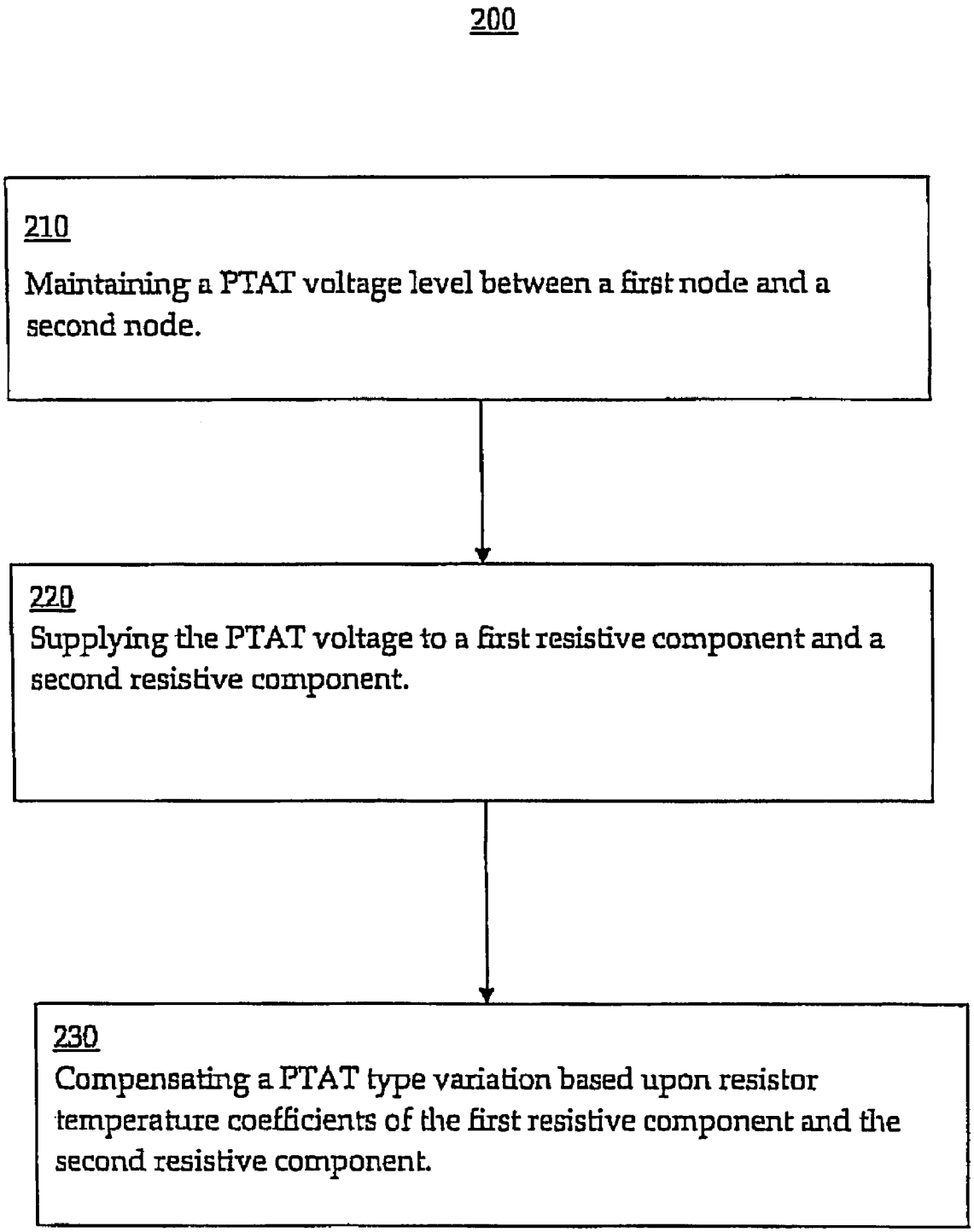
FIG. 2 is a flow chart of current reference method 200 in accordance with one embodiment of the present invention.

FIG. 2 is a flow chart of current reference method 200 in accordance with one embodiment of the present invention. In one embodiment, current reference method 200 provides a relatively precise reference current.

In step 210, a PTAT voltage is maintained between a first node and a second node. In one embodiment, the voltage generated is a PTAT voltage generated by a difference in emitter to base voltages of a first and a second BJT.

In step 220, the PTAT voltage is supplied to a first resistive component and a second resistive component.

In step 230, a PTAT type variation is compensated based upon resistor temperature coefficients of the first resistive component and the second resistive component. In one embodiment, the temperature coefficient of the first resistive component is different from the temperature coefficient of the second resistive component.

Figure 3:
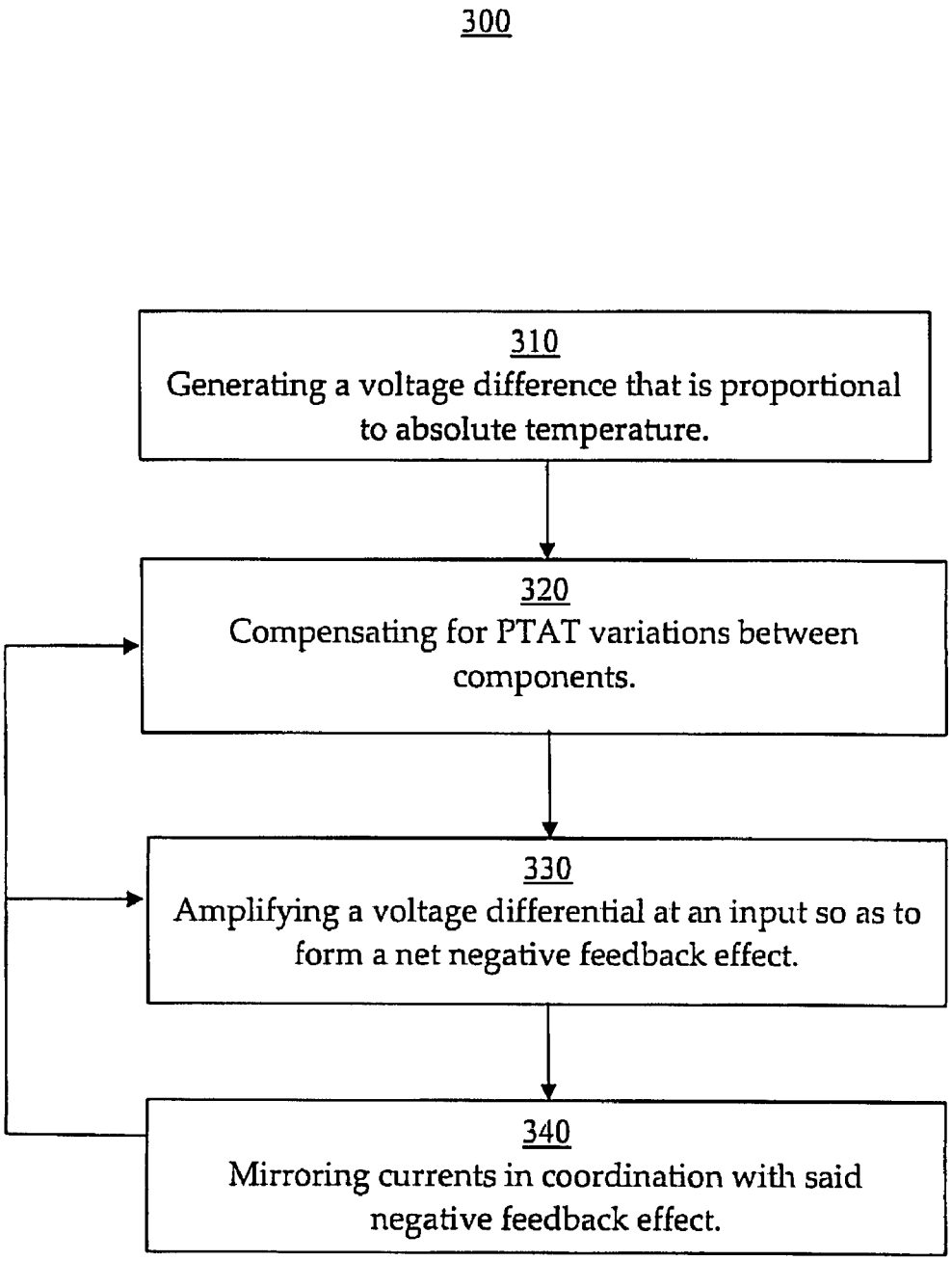
FIG. 3 is a flow chart of another exemplary current reference method in accordance with one embodiment of the present invention.

FIG. 3 is a flow chart of another exemplary current reference method 300 in accordance with one embodiment of the present invention. In one embodiment, current reference method 300 is similar to current reference method 200 and provides a reliable current source with compensation for PVT variations. A wide range of reference currents can be generated.

In block 310, a voltage difference that is proportional to absolute temperature is generated. In one embodiment, the voltage difference is generated by components with different current densities. In one exemplary implementation, wherein said generating includes utilizing well defined PTAT voltage variation generated by bipolar junction transistors (BJTs).

In block 320, the PTAT variations between components are compensated. In one embodiment, PTAT variations between components of a first branch and a second branch are compensated for. In one exemplary implementation, components of different temperature coefficients are utilized to resist current flow in a manner that compensates for PTAT variations.

In block 330, the voltage differential is amplified at an input so as to form a negative feedback effect. In one embodiment, an operational amplifier is utilized in amplifying the voltage differential.

In block 340, currents are mirrored in coordination with the negative feedback effect. In one embodiment, a feedback controlled current mirror completes the negative feedback system by mirroring currents. For example, mirroring currents in a first and a second branch.

In one embodiment, various components utilized in implementing exemplary current reference method 300 are selected to facilitate creation of a wide range of reference currents.

Thus, the present current reference systems and methods provide an innovative way to get a relatively precise zero temperature coefficient current reference without the use of expensive off-chip zero temperature coefficient resistors. This means there is no need to add a route to the pads to the external off chip world and the external resistor. This also saves valuable silicon area that the pads would have occupied if off-chip resistors were used. The current reference is also very accurate across PVT which effectively results in faster read accesses with better sense margins in a memory chip. Better sense margins translate into better robustness of the read sensing scheme which finally translates into better yield during fabrication. In one exemplary implementation, the reference circuit makes use of on-chip resistors like diffusion, polysilicon, local interconnect or metal resistors which are readily available in a CMOS technology. Systems and methods of the present invention can use devices (e.g., metal oxide semiconductor (MOS) transistors) in deep inversion saturation and hence matching is very good. The design is very flexible due to multiple options in selecting the resistor components in a typical CMOS technology.

The present invention is not constrained by traditional limitations associated with process-voltage-temperature variations that tend to limit the flexibility and often the precision of conventional approaches. For example, classical circuits that attempt to give a current of Vref/R that is constant with temperature requires resistor R with zero temperature co-efficient and the voltage reference to have a zero temperature co-efficient. In addition, conventional resistors with near zero temperature coefficients are usually external resistors (e.g., off chip resistors) that are typically very expensive. If on-chip resistors (e.g., diffusion, poly, etc. resistors) are used, a traditional current reference is usually affected by the temperature co-efficient of the on-chip resistors whereas present relatively precise current reference systems and methods are not affected by temperature. Typically traditional reference currents using on-chip resistors have accuracy in the range of +/−8% to +/−15% due to temperature changes and a total accuracy of around +/−20% to +/−25% across PVT corners, whereas present relatively precise current reference systems and methods can be more precise.

In conventional approaches in which a current reference based on a PTAT voltage applied to a positive temperature co-efficient (TC) resistor is constant with temperature only if the resistor's TC equals the PTAT voltage TC (given by the difference in Vbe of two bipolar junctions). In practice this is very difficult to achieve because the TC of delta Vbe has a linear term proportional to temperature but the temperature coefficient of a resistor (e.g., even an expensive one) has an offset term in addition to a linear even if higher order polynomial terms are ignored. This approach also typically involves the use of very expensive external resistors (e.g., a combination of such expensive resistors) and/or a very critical manufacturing process to control on chip resistors. Also, the usual processes don't use resistors with such large temperature coefficients as the PTAT voltage.

Conventional Oguey's Current Reference usually has an approx $T^{0.5}$ dependence on temperature (T) assuming the mobility varies as $T^{-1.5}$ for the temperature range of interest (−40 C to 145 C). Hence this reference has an accuracy of about +/−15% across temperature and is +/−20% to +/−25% across PVT variations. Since this reference system uses transistors in sub-threshold region, they are also more prone to mismatch related inaccuracies.

Current references based on Vt (e.g., threshold of MOSFET) often suffer from Vt and resistance changes due to both temperature and process corners. These usually have less accuracy of around +/−50%.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

What is claimed is:

1. A current reference system comprising:

an opamp for indicating and correcting the potential difference between a first branch and a second branch;

a first transistor and a second transistor for mirroring currents in the first branch and the second branch;

a first resistor and a second resistor having different temperature coefficients, wherein voltage drops across the first resistor and the second resistor compensate for PTAT variations; and a third transistor in said first branch and a fourth transistor in said second branch for providing a PTAT voltage, wherein the area of the third transistor is P times the area of the fourth transistor.

2. A current reference system of claim 1 wherein said first transistor and said second transistor are PMOS transistors.

3. A current reference system of claim 1 wherein said third transistor and said fourth transistor are PNP BJTs.

4. A current reference system of claim 1 wherein said first resistor is a diffusion resistor and said second resistor is a poly resistor.

5. A current reference system of claim 1 wherein said first resistor is a poly resistor and said second resistor is a local interconnect resistor.

6. A current reference system of claim 1 wherein said first resistor is a local interconnect resistor and said second resistor is a metal resistor.

7. A current reference system of claim 1 wherein said first transistor and said second transistor are sized such that the current through said second transistor is N times the current through said first transistor.

8. A current reference system of claim 1 wherein a relatively stable current is generated by compensating a PTAT type variation with said first and second resistors having different temperature coefficients.

9. A current reference method, comprising:

generating a voltage difference that is proportional to absolute temperature using a first transistor and a second transistor, wherein the first transistor has an area that is P times the area of the second transistor;

compensating for PTAT variations between components using a first resistor and a second resistor, wherein the first resistor and the second resistor have different temperature coefficients;

amplifying a voltage differential at an input so as to form a net negative feedback effect; and mirroring currents in coordination with said negative feedback effect.

10. A current reference method of claim 9 wherein said generating includes utilizing well defined PTAT voltage variation generation by the first transistor and the second transistor, wherein the first transistor and the second transistor are bipolar junction transistors (BJTs).

11. A current reference method of claim 9 further comprising utilizing metal oxide semiconductor (MOS) transistors in deep inversion saturation.

12. A current reference method of claim 9 further comprising generating a wide range of reference currents.

13. A current reference method of claim 12 further comprising selecting various components to facilitate said wide range of reference currents.

14. A current reference method of claim 9, wherein said voltage difference that is proportional to absolute temperature is proportional to a PTAT voltage generated by a first and second BJT.

15. A current reference system comprising:

a PTAT voltage generator providing a PTAT voltage wherein the PTAT voltage generator comprises a first transistor and a second transistor, wherein the first transistor has an area that is P times the area of the second transistor;

a PTAT compensator for compensating for PTAT variations between a component of a first branch and a component of a second branch, wherein the PTAT compensator comprises a first resistor connected with the component of the first branch and a second resistor connected with the component of the second branch;

a potential difference sensor and amplifier with feedback for adjusting electrical potential differences between a first branch and a second branch using amplifier feedback action; and a feedback controlled current mirror for mirroring currents in the first branch and the second branch.

16. A current reference system of claim 15 wherein said PTAT voltage generator includes two bipolar transistors of different current densities.

17. A current reference system of claim 15 wherein the current reference is accurate across PVT variations.

18. A current reference system of claim 15 wherein said PTAT compensator comprises a first resistor and a second resistor of different temperature coefficients for resisting current flow through the first branch and the second branch in a manner that compensates for PTAT variations.

19. A current reference system of claim 1, wherein a magnitude of current in the first branch is defined by $$I_1 = \frac{\left(\frac{K}{q}\right)\ln(NP)}{\alpha_1 R_{10} - \alpha_2 N R_{20}}$$

wherein $I_1$ represents the magnitude of the current in the first branch, K is Boltzmann's constant, q is an electron charge constant, N is a ratio of the currents of the first transistor and the second transistor, $\alpha_1$ and $\alpha_2$ are constant first order temperature coefficients of the first and second resistors, respectively, and $R_{10}$ and $R_{20}$ are resistance values associated with the first and second resistors, respectively.

20. A current reference method of claim 9, wherein a magnitude of a first current of the mirrored currents is defined by $$I_1 = \frac{\left(\frac{K}{q}\right)\ln(NP)}{\alpha_1 R_{10} - \alpha_2 N R_{20}}$$

wherein $I_1$ represents the magnitude of the first current, K is Boltzmann's constant, q is an electron charge constant, N is a ratio of the first current and a second of the mirrored currents, $\alpha_1$ and $\alpha_2$ are constant first order temperature coefficients of the first and second resistors, respectively, and $R_{10}$ and $R_{20}$ are resistance values associated with the first and second resistors, respectively.

21. A current reference system of claim 15, wherein a magnitude of current in the first branch is defined by $$I_1 = \frac{\left(\frac{K}{q}\right)\ln(NP)}{\alpha_1 R_{10} - \alpha_2 N R_{20}}$$

wherein $I_1$ represents the magnitude of the current in the first branch, K is Boltzmann's constant, q is an electron charge constant, N is a ratio of the currents of the first transistor and the second transistor, $\alpha_1$ and $\alpha_2$ are constant first order temperature coefficients of the first and second resistors, respectively, and $R_{10}$ and $R_{20}$ are resistance values associated with the first and second resistors, respectively.

* * * * *